US009426858B2

(12) United States Patent
Park

(10) Patent No.: US 9,426,858 B2
(45) Date of Patent: Aug. 23, 2016

(54) DEVICE FOR DRIVING MULTI-CHANNEL LIGHT-EMITTING DIODE

(75) Inventor: Shi-Hong Park, Seoul (KR)

(73) Assignee: POINT TEK CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/345,240

(22) PCT Filed: Sep. 12, 2012

(86) PCT No.: PCT/KR2012/007319
§ 371 (c)(1),
(2), (4) Date: Mar. 15, 2014

(87) PCT Pub. No.: WO2013/039324
PCT Pub. Date: Mar. 21, 2013

(65) Prior Publication Data

US 2015/0054407 A1 Feb. 26, 2015

(30) Foreign Application Priority Data

Sep. 15, 2011 (KR) ..... 10-2011-0093137
Mar. 27, 2012 (KR) ..... 10-2012-0031329

(51) Int. Cl.
*H05B 33/08* (2006.01)

(52) U.S. Cl.
CPC ..... *H05B 33/083* (2013.01)

(58) Field of Classification Search
CPC ..... H05B 33/083
See application file for complete search history.

(56) References Cited

U.S. PATENT DOCUMENTS 4,318,037 A * 3/1982 Amaro ..... 315/411
2005/0200308 A1* 9/2005 Rimmer et al. ..... 315/291

(Continued)

FOREIGN PATENT DOCUMENTS

JP 2006-230896 A 9/2006
JP 2007-027316 A 2/2007
KR 10-0942234 B1 2/2010
KR 10-2011-0013167 A 2/2011

OTHER PUBLICATIONS

International Search Report for PCT/KR2012/007319.
Written Opinion of the International Search Authority for PCT/KR2012/007319.

*Primary Examiner* — Douglas W Owens
*Assistant Examiner* — Pedro C Fernandez
(74) *Attorney, Agent, or Firm* — The PL Law Group, PLLC

(57) ABSTRACT

A device for driving a multi-channel light-emitting diode, includes a power supply unit for supplying power supplied from the outside; a light-emitting diode block, which is connected to a (+) terminal of the power supply unit and includes one or more light-emitting diode groups, each including at least one light-emitting diode; a current commutation unit, which is connected to a cathode of the light-emitting diode block and commutates a current flowing through the light-emitting diode groups; a reference voltage unit, which is electrically connected to the current commutation unit and provides a reference voltage to the current commutation unit; and a current driving unit for receiving power from the power supply unit, driving the light-emitting diode block through the current commutation unit, and determining a driving current flowing through the light-emitting diode groups.

39 Claims, 11 Drawing Sheets

(56) References Cited

U.S. PATENT DOCUMENTS

2008/0094000 A1* 4/2008 Yamamoto et al. ..... 315/250
2010/0134018 A1* 6/2010 Tziony et al. ..... 315/122
2010/0308738 A1* 12/2010 Shteynberg et al. ..... 315/185 R
2011/0084619 A1* 4/2011 Gray et al. ..... 315/185 R
2011/0273102 A1* 11/2011 van de Ven et al. ..... 315/193
2011/0273103 A1* 11/2011 Hong ..... 315/193

* cited by examiner

PRIOR ART

DEVICE FOR DRIVING MULTI-CHANNEL LIGHT-EMITTING DIODE

CROSS REFERENCE TO RELATED APPLICATIONS AND CLAIM OF PRIORITY

This patent application is a National Phase application under 35 U.S.C. §371 of International Application No. PCT/KR2012/007319, filed 12 Sep. 2012, which claims priority to Korean Patent Application Nos. 10-2011-0093137, filed 15 Sep. 2011, and 10-2012-0031329, filed 27 Mar. 2012, entire contents of which are incorporated herein by reference.

BACKGROUND

1. Field

The present invention relates, in general, to a multi-channel Light-Emitting Diode (LED) driving device and, more particularly, to a multi-channel LED driving device which is driven in a linear driving manner.

2. Description of the Related Art

Generally, an existing LED has been widely used as a backlight unit for a liquid crystal display device used in mobile phones, Personal Digital Assistants (PDAs), or notebook computers. Further, with the development of LED manufacturing technologies, efficiency is increased, brightness is greatly improved, and thus LEDs are not only used as light sources for large-sized LCD devices, such as televisions (TVs), but also widely used for typical lighting, security lights, street lamps, etc. An LED has a long lifespan, environment-friendly characteristics, and an expectation to be widely used for normal lighting in the future via continuous efforts to improve optical efficiency.

Generally, an LED is driven using a current driving scheme, and uses a commercial power of AC 220V or 110V when the LED is used for normal lighting. Further, driving schemes may be chiefly divided into a converter scheme in which an inductor and a capacitor are used as in the case of a switching mode power supply (SMPS), and a linear scheme in which an SMPS is not used. In the case of the converter scheme, electrical efficiency and optical efficiency are higher than those of the linear scheme, but the configuration of the system is complicated, and a large amount of noise appears when switching is performed, thus resulting in electromagnetic interference (EMI) and electromagnetic compatibility (EMC). Further, in the case of the converter scheme, a separate power factor correction circuit must be used to improve the power factor, and an additional circuit for suppressing the occurrence of electromagnetic waves upon switching must be configured, and thus the configuration of the system is complicated and the cost thereof is high. A typical linear scheme has a simple system configuration, but has low electrical efficiency and a low power factor, and thus it is not widely used. An improved linear scheme has been introduced so as to solve this disadvantage and extensive efforts have been made to improve the power factor and efficiency, but there is still much room for improvement in this scheme that has been introduced.

FIG. 20 illustrates a conventional LED driving circuit based on an initial linear driving scheme. This is a structure for driving LEDs by simultaneously turning on/off all the LEDs in an interval during which an input voltage is higher than a voltage required to turn on all the LEDs, and exhibits the characteristics of a low power factor and low efficiency, but enables a simple configuration.

FIG. 21 illustrates a conventional LED driving circuit based on an improved linear driving scheme. This is configured to apply a scheme for dividing LEDs into 3 to 4 channels and sequentially driving LED channels in response to an input voltage, thus improving the power factor and efficiency. However, this scheme is limited in that an interval during which each channel is operated must be previously set by sensing an input voltage, and in that when the voltage of an LED is changed within a preset voltage range, reduced efficiency or deteriorated characteristics are evident, thus making it very difficult to configure multiple channels. Further, the configuration of a circuit for multi-channel configuration is also very complicated. When the number of channels increases, efficiency and power factor, which are the most important characteristics of lighting, can be simultaneously improved.

In the case of 4-channel driving, a single channel has a voltage drop of about 60V based on an AC input voltage of 220V. If schematic efficiency is calculated via the number of operating channels for each input voltage and an average voltage, the following Table 1 may be obtained.

TABLE 1

| | Vin (V) | LED voltage drop (V)/ number of operating channels | Interval average voltage (V) | Interval efficiency (%) |
|---|---|---|---|---|
| Interval 1 | 0-60 | 0/0 | 30 | — |
| Interval 2 | 60-120 | 60/1 | 90 | 66.7 |
| Interval 3 | 120-180 | 120/2 | 150 | 80.0 |
| Interval 4 | 180-240 | 180/3 | 210 | 85.7 |
| Interval 5 | 240-311 | 240/4 | 275.5 | 87.1 |

For schematic calculation, overall efficiency is calculated by averaging the efficiency values of respective intervals, and is 79.9%. When only interval 5 is used without sequentially turning on LEDs, electrical efficiency is high, but an interval during which LEDs are turned on is short, and thus optical efficiency is low and the power factor is also low.

In the case of 8-channel driving, if a voltage drop of one channel is assumed to be 35 V, and efficiency is calculated in the same manner, the following Table 2 is obtained.

TABLE 2

| | Vin (V) | LED voltage drop (V)/ number of operating channels | Interval average voltage (V) | Interval efficiency (%) |
|---|---|---|---|---|
| Interval 1 | 0-35 | 0/0 | 35 | |
| Interval 2 | 35-70 | 35/1 | 52.5 | 66.7 |
| Interval 3 | 70-105 | 70/2 | 87.5 | 80.0 |
| Interval 4 | 105-140 | 105/3 | 122.5 | 85.7 |
| Interval 5 | 140-175 | 140/4 | 157.5 | 88.9 |
| Interval 6 | 175-210 | 175 | 192.5 | 90.9 |
| Interval 7 | 210-245 | 210 | 227.5 | 92.3 |
| Interval 8 | 245-280 | 245 | 262.5 | 93.3 |
| Interval 9 | 280-311 | 280 | 295.5 | 94.6 |

In this way, in the case of 8-channel driving, the overall efficiency is 86.8%, which exhibits an increment of 6.9% compared to 79.9% in the case of 4-channel driving. However, since the input voltage has the form of a sine wave, and the slope thereof in intervals 1 and 2 is much sharper than that in intervals 8 and 9, a percentage occupied by intervals 1 and 2 is very low from the standpoint of time. If the overall efficiency is calculated again with the exception of intervals 1 and 2, it is 90.9%, which appears greater.

However, as shown in FIG. 21, when it is desired to detect an input voltage, select an area in which each LED group is turned on, and increase the number of LED groups (identical to the number of channels of a driving unit), the range of voltages at which each LED is operated is narrowed, and thus it is very difficult to set the operating range depending on variations in the voltage of LEDs. Further, a variation in the voltage drop of LEDs depending on temperature acts as a very considerable obstacle to an increase in the number of channels. In addition, as the number of channels increases, the size of a block required to detect the input voltage increases. As a result, most lighting systems are configured using only LED groups of 3-4 channels.

SUMMARY

Accordingly, provided is a multi-channel LED driving circuit, which can drive LEDs so that they are sequentially and exactly turned on and off even if an input voltage is not detected when the LEDs are driven using a linear scheme in which an inductor or a capacitor is not included.

In one embodiment, a multi-channel Light Emitting Diode (LED) driving device includes a power supply unit configured to supply externally supplied power; an LED block connected to a positive (+) terminal of the power supply unit, the LED block including one or more LED groups, each having at least one LED; a current commutation unit connected to a cathode of the LED block and configured to commutate current flowing through the LED groups; a reference voltage unit electrically connected to the current commutation unit and configured to provide a reference voltage to the current commutation unit; and a current driving unit supplied with the power from the power supply unit, and configured to drive the LED block via the current commutation unit and determine drive current flowing through the LED groups.

In this case, the current commutation unit may include one or more transistors, respectively, electrically connected to the one or more LED groups included in the LED block, and the one or more transistors may be N-type metal-oxide-semiconductor field-effect transistors (MOSFETs) or NPN transistors.

Further, each of the one or more transistors included in the current commutation unit may be configured such that a collector thereof is connected to a cathode of a corresponding LED group, a base thereof is electrically connected to the reference voltage unit, and an emitter thereof is electrically connected to the current driving unit. In this case, the drive current determined by the current driving unit may be determined to be proportional to an input voltage.

Further, the LED block may include a plurality of LED groups, and the current driving unit may determine the drive current so that currents having different magnitudes flow through the LED groups depending on driving of the LED groups.

Furthermore, the current driving unit may include a resistor, the LED block may include a plurality of LED groups, the reference voltage unit may include a plurality of reference voltage sources, respectively, electrically connected to the plurality of LED groups, and the current driving unit may determine the drive current so that different currents flow through the plurality of LED groups depending on reference voltages respectively supplied by the plurality of reference voltage sources and the resistor.

Furthermore, the LED block may include a plurality of LED groups, the current commutation unit may include a plurality of transistors, and the reference voltage unit may include a common collector circuit to improve temperature characteristics of drive current determined when a resistor is included in the current driving unit.

In this case, a bias circuit of the common collector circuit is either externally supplied with power or connected to an emitter of a common base circuit.

Further, the bias circuit of the common collector circuit may be implemented using a current source or a resistor.

Furthermore, the LED block may include a plurality of LED groups, the current commutation unit may include a plurality of transistors, and the current commutation unit may further include a common base circuit.

In this case, the LED block may include a plurality of LED groups, the current commutation unit may include a plurality of transistors, and the plurality of transistors may be implemented using transistors having different sizes.

Further, the LED block may include a plurality of LED groups, the current commutation unit may include a plurality of transistors, the current commutation unit may further include a plurality of resistors respectively connected to emitters of the plurality of transistors, and the resistors respectively connected to the plurality of transistors may have different resistance values.

Furthermore, the reference voltage unit may provide a single reference voltage to the current commutation unit.

In this case, the current commutation unit may include amplifiers for amplifying voltages input from the reference voltage unit, and respective bases of the one or more transistors may be electrically connected to the amplifiers.

Further, an input voltage of the amplifiers may be implemented using supplied power or connected to an emitter of a common base circuit.

Furthermore, the current commutation unit may be configured to implement a Darlington circuit using bipolar junction transistors (BJTs) or MOSFETs.

In this case, the LED block may include a plurality of LED groups, the reference voltage unit may include a plurality of reference voltage sources, respectively, electrically connected to the plurality of LED groups, and the plurality of reference voltage sources may set different voltages, wherein a difference between the voltages of the reference voltage sources is a voltage difference enabling the current commutation unit to commutate current flowing through the LED groups using the drive current determined by the current driving unit.

Further, the LED block may include a plurality of LED groups, and the plurality of LED groups may be connected in series.

In another embodiment, a multi-channel Light Emitting Diode (LED) driving device includes a power supply unit configured to supply externally supplied power; an LED block connected to a negative (−) terminal of the power supply unit, the LED block including one or more LED groups, each having at least one LED; a current commutation unit connected to an anode of the LED block and configured to commutate current flowing through the LED groups; a reference voltage unit electrically connected to the current commutation unit and configured to provide a reference voltage to the current commutation unit; and a current driving unit supplied with the power from the power supply unit, and configured to drive the LED block via the current commutation unit and determine drive current flowing through the LED groups.

In this case, the current commutation unit may include one or more transistors, respectively, electrically connected to the one or more LED groups included in the LED block.

Further, each of the one or more transistors included in the current commutation unit may be configured such that a collector thereof is connected to an anode of a corresponding LED group, a base thereof is electrically connected to the reference voltage unit, and an emitter thereof is electrically connected to the current driving unit.

In this case, the drive current determined by the current driving unit may be determined to be proportional to an input voltage.

Furthermore, the LED block may include a plurality of LED groups, and the current driving unit may determine the drive current so that currents having different magnitudes flow through the LED groups depending on driving of the LED groups.

Furthermore, the current driving unit may include a resistor, the LED block may include a plurality of LED groups, the reference voltage unit may include a plurality of reference voltage sources, respectively, electrically connected to the plurality of LED groups, and the current driving unit may determine the drive current so that different currents flow through the plurality of LED groups depending on reference voltages respectively supplied by the plurality of reference voltage sources and the resistor.

Furthermore, the LED block may include a plurality of LED groups, the current commutation unit may include a plurality of transistors, and the reference voltage unit may include a common collector circuit to improve temperature characteristics of drive current determined when a resistor is included in the current driving unit.

In this case, a bias circuit of the common collector circuit in the reference voltage unit may be either externally supplied with power or connected to an emitter of a common base circuit.

Further, the bias circuit of the common collector circuit may be implemented using a current source or a resistor.

Furthermore, the LED block may include a plurality of LED groups, the current commutation unit may include a plurality of transistors, and the current commutation unit further includes a common base circuit.

In this case, the LED block may include a plurality of LED groups, the current commutation unit may include a plurality of transistors, and the plurality of transistors may be implemented using transistors having different sizes.

Further, the LED block may include a plurality of LED groups, the current commutation unit may include a plurality of transistors, the current commutation unit may further include a plurality of resistors respectively connected to emitters of the plurality of transistors, and the resistors respectively connected to the plurality of transistors have different resistance values.

Furthermore, the reference voltage unit may provide a single reference voltage to the current commutation unit.

In this case, the current commutation unit may include amplifiers for amplifying voltages input from the reference voltage unit, and respective bases of the one or more transistors may be electrically connected to the amplifiers.

Further, an input voltage of the amplifiers may be either implemented using externally supplied power or connected to an emitter of a common base circuit.

Furthermore, the reference voltage unit and the current driving unit may set a voltage at a positive (+) terminal of the voltage supply unit to a reference voltage, and the current commutation unit may be implemented using a P-type MOSFET or a PNP transistor.

In this case, the LED block may include a plurality of LED groups, the reference voltage unit may include a plurality of reference voltage sources, respectively, electrically connected to the plurality of LED groups, and the plurality of reference voltage sources may set different voltages, wherein a difference between the voltages of the reference voltage sources is a voltage difference enabling the current commutation unit to commutate current flowing through the LED groups using the drive current determined by the current driving unit.

Further, the LED block may include a plurality of LED groups, and the plurality of LED groups may be connected in series.

Furthermore, the current commutation unit may include an amplifier for amplifying a voltage input from the reference voltage unit, and may include comparators for comparing two or more reference voltages input from the reference voltage unit.

Furthermore, the LED block may include one or more of a resistor, a zener diode, and a typical diode electrically connected to the one or more LED groups.

As described in the above embodiments, the multi-channel LED driving device determines whether an input voltage is a voltage sufficient to turn on individual LED groups without information about an input voltage, enables different LED groups to be used, enables the LEDs to be stably driven even at variations in the voltage drop of the LEDs, and simplifies a circuit configuration, thus making it very suitable for multi-channel driving.

Further, embodiments of the multi-channel LED driving device can simultaneously achieve both very high efficiency and a high power factor upon driving multi-channel LED groups, and can reduce the occurrence of EMI or EMC because embodiments of the multi-channel LED driving device includes neither an inductor nor a capacitor.

DETAILED DESCRIPTION

Figure 1:
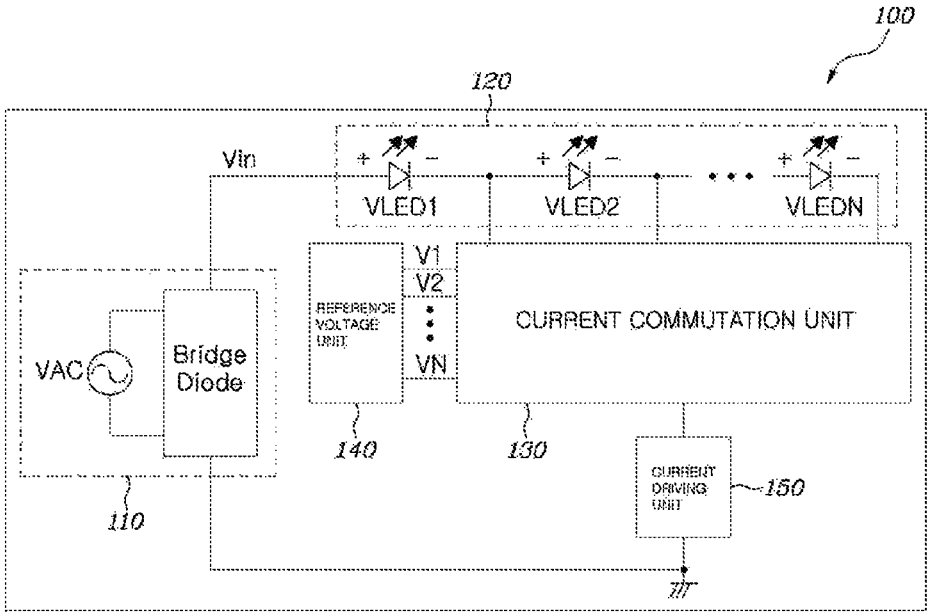
FIG. 1 is a block diagram showing a multi-channel LED driving device as in one embodiment of the invention.

Embodiments of the invention will be described below in detail with reference to the attached drawings, and descriptions of well-known technical parts will be omitted or compressed for clarity.

In one embodiment, a multi-channel LED driving device 100 includes a power supply unit 110, an LED block 120, a current commutation unit 130, a reference voltage unit 140, and a current driving unit 150. This configuration will be described with reference to FIGS. 1 to 11.

FIG. 1 is a block diagram showing the multi-channel LED driving device 100 in one embodiment of the invention.

The power supply unit 110, which supplies externally supplied power, rectifies the externally supplied power via a bridge diode, and then supplies rectified positive power. In this case, a voltage output from the bridge diode is represented by Vin or an input voltage.

The LED block 120 is configured such that n LED groups are connected in series, and each LED group includes at least one LED.

The current commutation unit 130 is electrically connected to the cathodes of respective LED groups, and is configured to commutate current so that a plurality of LED groups included in the LED block 120 are sequentially turned on or off.

The reference voltage unit 140 is electrically connected to the current commutation unit 130 and is configured to provide reference voltages so that the current commutation unit 130 allows the plurality of LED groups to be sequentially turned on or off. In this case, the reference voltage unit 140 may include one or more reference voltage sources.

The current driving unit 150 determines the magnitude of current flowing through the LED groups, wherein the voltage drop of each LED group does not need to equally occur. Therefore, the current determined by the current driving unit 150 may be constant, may be proportional to the input voltage, or may be determined to be different values depending on turning-on conditions of the respective LED groups.

Figure 2:
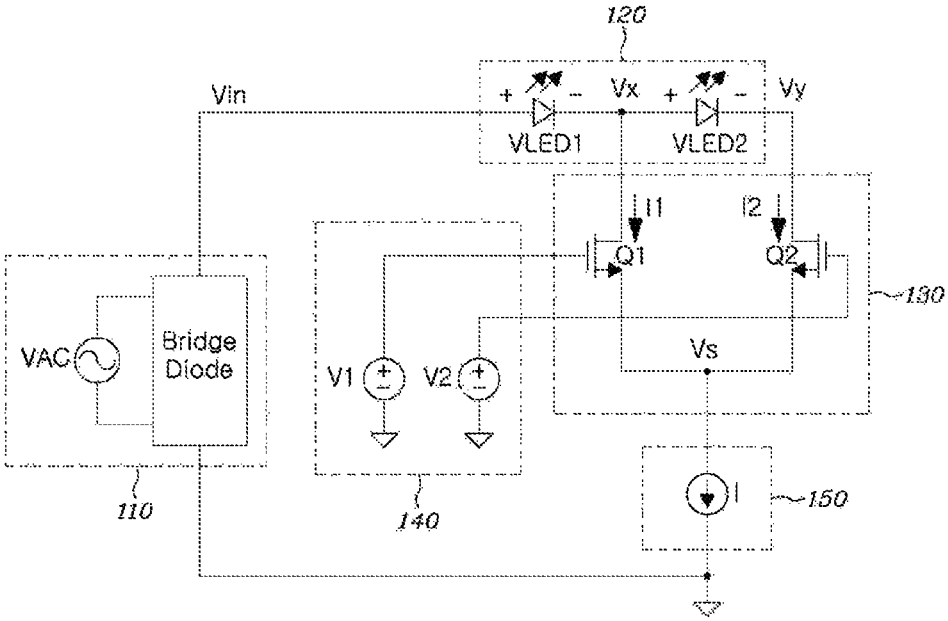
FIG. 2 illustrates an embodiment of a multi-channel LED driving device of the invention, which is a circuit diagram showing the case of two channels.

FIG. 2 is a diagram showing the operating principle of one embodiment of the invention, and is a circuit diagram showing an embodiment of the multi-channel LED driving device 100 in the case of two channels which are basic elements of multi-channel driving. The current commutation unit 130 is configured such that two transistors are configured as a source (emitter)-coupled pair, and has a structure in which the gates (bases) of the respective transistors are connected to reference voltage sources, the drains (collectors) thereof are connected to the cathodes of respective LED groups, and the sources (emitters) thereof are short-circuited and connected to the current driving unit 150. The voltage of reference voltage source V2 must be larger than that of V1, and causes all the current of the current driving unit 150 to flow as 12 when the two transistors are operated in an active region in which they simultaneously act as current sources.

The operating regions may be divided as follows according to the magnitude of Vin:

$$Vin < VLED1 \quad 1)$$

$$VLED1 < Vin < VLED2 \quad 2)$$

$$Vin > VLED1 + VLED2 \quad 3)$$

where Vin denotes an input voltage, VLED1 denotes the forward voltage drop of the first LED group, and VLED2 denotes the forward voltage drop of the second LED group.

In the case of 1), since the input voltage is less than the forward turn-on voltage of LED1, both LED1 and LED2 are turned off, and the current driving unit 150 loses a current path. In the condition of 1), the states of the important voltages and currents are given as follows:

$$I1 = I2 = 0\ \text{A}, Vs = Vx = Vy = 0[V]$$

where I1 denotes the drain (collector) current of Q1, I2 denotes the drain (collector) current of Q2, Vs denotes a common source (emitter) voltage, Vx denotes the drain (collector) voltage of Q1, and Vy denotes the drain (collector) voltage of Q2.

In the case of 2), the input voltage is sufficient to turn on LED1, but is not sufficient to turn on LED2, and thus LED1 is turned on and LED2 is turned off. As a result, I flows through Q1 and then flows only through LED1. In the condition of 2), the states of important voltages and currents are given as follows:

$$I1 = I, I2 = 0\ \text{A}, Vs = V1 - \text{VGS1}, Vy = Vs$$

where V1 denotes a first reference voltage, and VGS1 denotes the gate-source (base-emitter) voltage of Q1.

In the case of 3), since the input voltage is greater than the sum of the voltage drops of LED1 and LED2, both Q1 and Q2 satisfy conditions allowing current to flow therethrough, but Q1 and Q2 configure a source (emitter)-coupled pair circuit, and V2 is greater than V1, and thus all the current of the current driving unit 150 flows through Q2, and current I flows through LED1 and LED2. That is, as the value of Vs increases, VGS1 is reduced by the following equation and is insufficient to turn on Q1, and thus I1=0 [A], $$\text{VGS1} = V1 - Vs = V1 - (V2 - \text{VGS2}) = (V1 + \text{VGS2}) - V2$$

where V2 denotes a second reference voltage, and VGS2 denotes the gate-source (base-emitter) voltage of Q2.

In a condition in which LED2 is turned on, I1=0 [A] must be satisfied to obtain maximum efficiency. The voltage condition of V2 satisfying this requirement may be obtained from the operation of a source (emitter)-coupled pair. The case of an emitter-coupled pair using relatively simple bipolar junction transistors (BJTs) is exemplified as follows:

$$I>0.99\times I \text{ if } V2-V1=0.1[V]$$

That is, even at a small voltage differences between V1 and V2, current commutating conditions may be set, and then this configuration is very useful for multi-channel driving.

Figure 3:
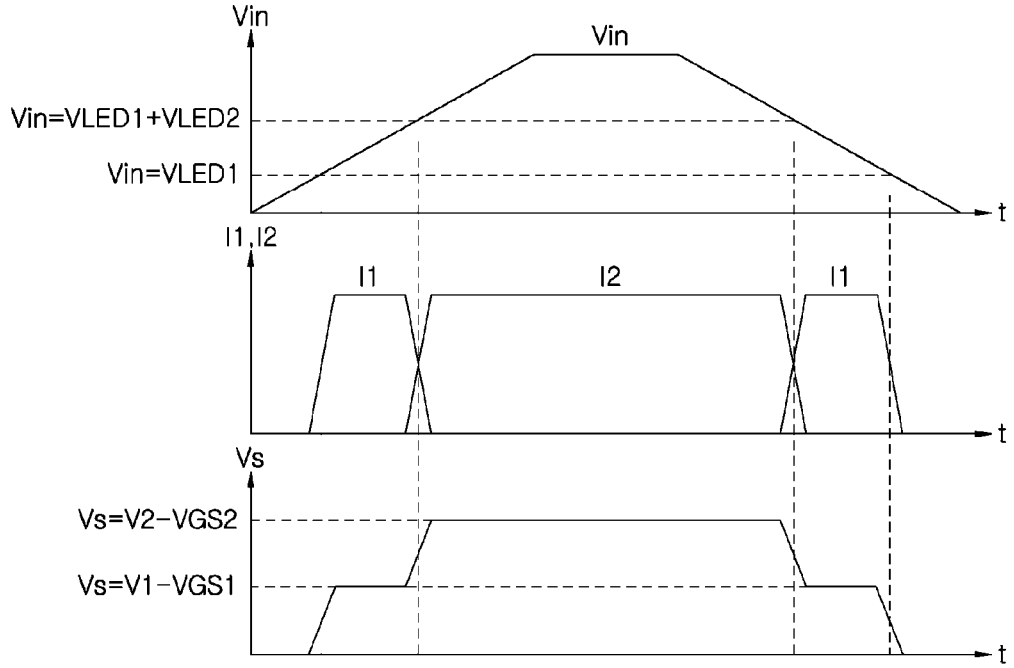
FIG. 3 is a diagram showing the operation of the multi-channel LED driving device as in one embodiment of the invention depending on the magnitude of an input voltage.

FIG. 3 is a diagram showing the operation of commutation between I1 and I2 when the input voltage increases or decreases in FIG. 2. If Vin is a voltage sufficient to turn on LED1 even though Vin is not detected, the current of the current driving unit 150 flows as I1. If Vin is a voltage sufficient to turn on even LED2, I1=0 [A], the current of the current driving unit 150 simultaneously flows through both LED1 and LED2 as 12. In a transition interval during which current makes a transition from I1 to I2 or, on the contrary, from I2 to I1, the operation of the source (emitter)-coupled pair appears without change, so that current is commutated with the sum of I1 and I2 maintained at I, thus exhibiting good characteristics of minimizing a current ripple at the input voltage source.

If the operation is summarized as a whole, when the input voltage is increased and a condition required to cause current to flow through LEDs is satisfied by applying the magnitudes of reference voltage sources V1 and V2 as different values, and by causing preset current to flow via the combination of the characteristics of the source (emitter)-coupled pair, current commutation between individual LEDs may be smoothly performed while the set current automatically flows through required LED groups without detecting the input voltage.

Even if the voltages of respective LED groups are different, or the voltage drops of the respective LED groups are varied depending on temperature, current commutation time is automatically adjusted. As a result, one aspect of the invention performs a stable operation even if multiple channels are used, and is capable of achieving a high power factor while greatly increasing electrical efficiency and optical efficiency.

Figure 4:
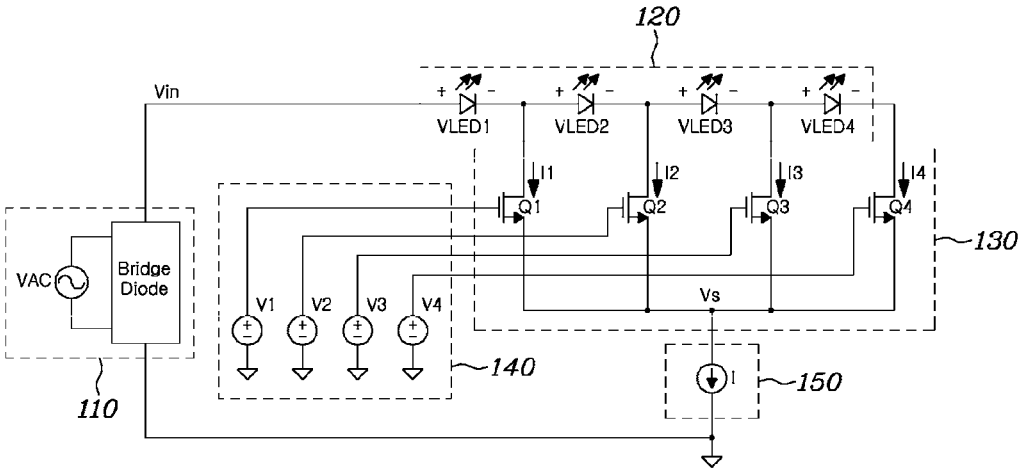
FIG. 4 illustrates an embodiment of a multi-channel LED driving device of the invention, which is a circuit diagram showing the case of four channels.

FIG. 4 is a circuit diagram showing an embodiment of the driving circuit of the multi-channel LED driving device 100, which shows a 4-channel driving circuit. Based on this, variations in the circuit depending on an increase or a decrease in the number of channels may be easily predicted. As the number of channels increases, reference voltage sources and transistors of the current commutation unit 130 corresponding to the number of channels are added. Even if the number of channels increases, only one of transistors Q1 to Q4 is turned on in response to the value of Vin, and an operation is performed such that, if a transistor corresponding to a higher number is turned on, transistors corresponding to all lower numbers are turned off. In a transition interval, current commutation occurs between only two neighboring transistors, such as Q1 and Q2, Q2 and Q3, and Q3 and Q4, and this operation is performed in the same manner as the basic circuit shown in FIG. 2.

Figure 5:
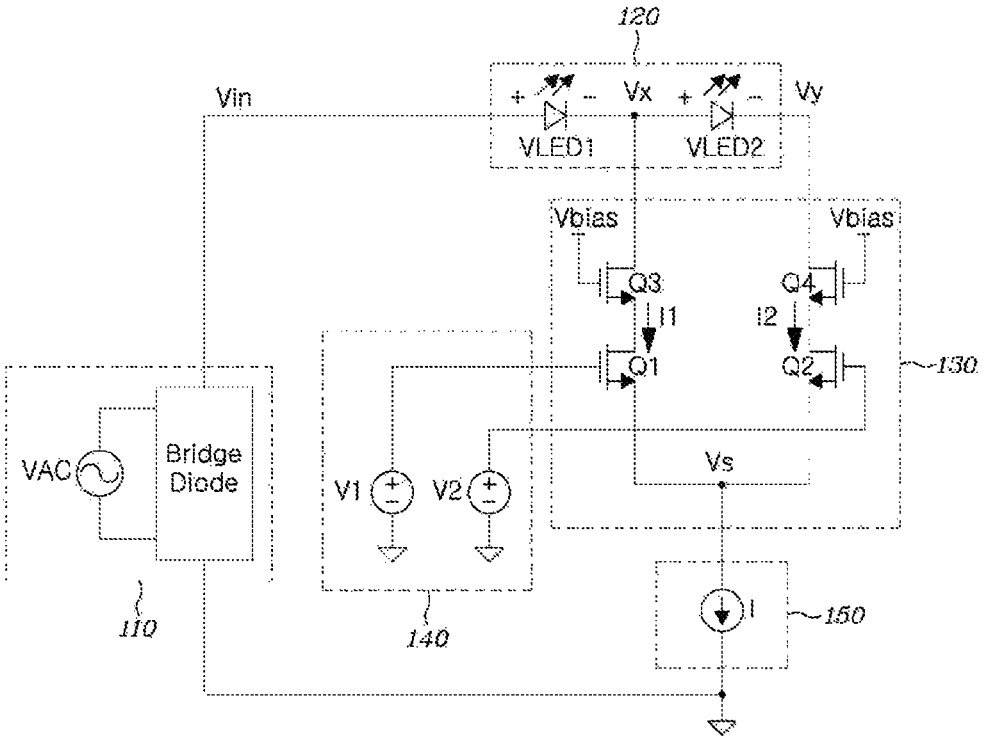
FIG. 5 illustrates an embodiment of a multi-channel LED driving device of the invention, which is a circuit diagram showing the addition of a common gate (base) circuit.

FIG. 5 illustrates a configuration in which a common gate (base) circuit composed of Q3 and Q4 is added to the circuit of FIG. 2. In this structure, Q3 and Q4 are used as high-voltage transistors, and Q1 and Q2 are used as low-voltage transistors. The basic operation thereof is identical to that of the basic circuit shown in FIG. 2.

Figure 6:
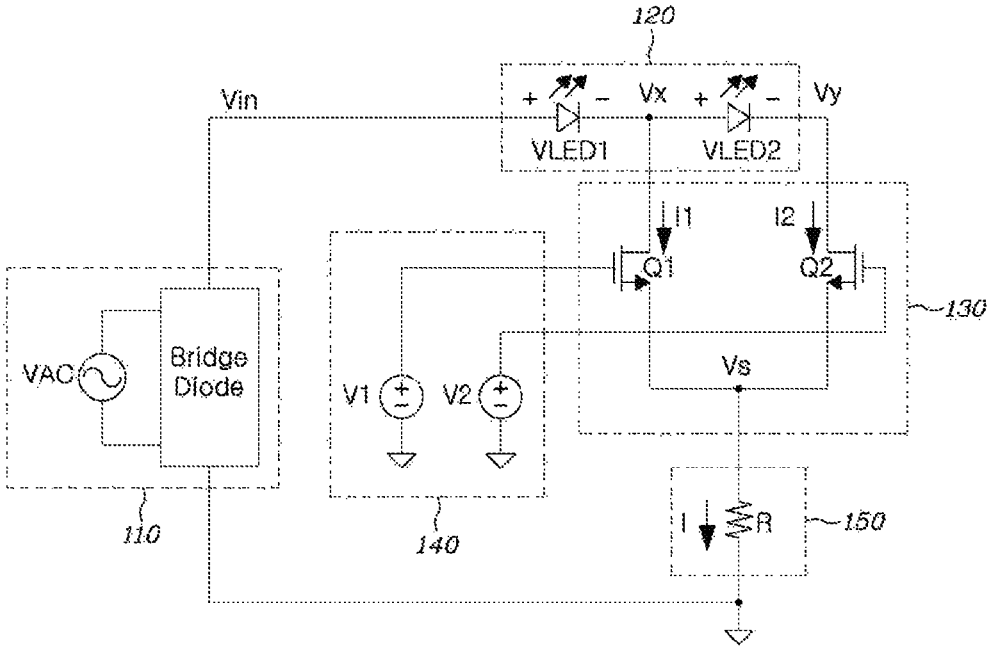
FIG. 6 illustrates an embodiment of a multi-channel LED driving device of the invention, which is a circuit diagram showing a case where a current driving unit is configured using a resistor.

FIG. 6 illustrates a circuit in which a resistor is used instead of a current source as the component of the current driving unit 150 in FIG. 2. In this structure, when I1 at which Q1 is turned on and I2 at which Q2 is turned on may be set to different values, they may be determined by the following equations:

$$I1=Vs/R=(V1-\mathrm{VGS1})/R$$

$$I2=Vs/R=(V2-\mathrm{VGS2})/R$$

Figure 7:
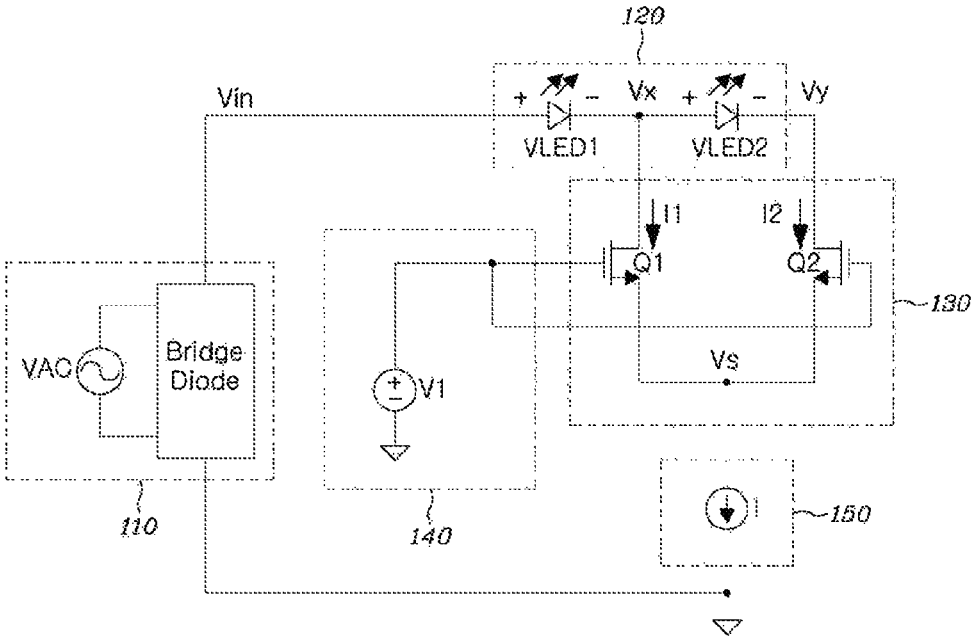
FIG. 7 illustrates an embodiment of a multi-channel LED driving device of the invention, which is a circuit diagram showing a case where a current commutation unit is configured by setting the sizes of transistors of a source (emitter)-coupled pair to different sizes.

FIG. 7 illustrates a circuit in which a single reference voltage source is used and the sizes of Q1 and Q2 are set to different sizes, and in which current commutation causing Q1 to be turned off when Q2 is turned on is implemented.

Figure 8:
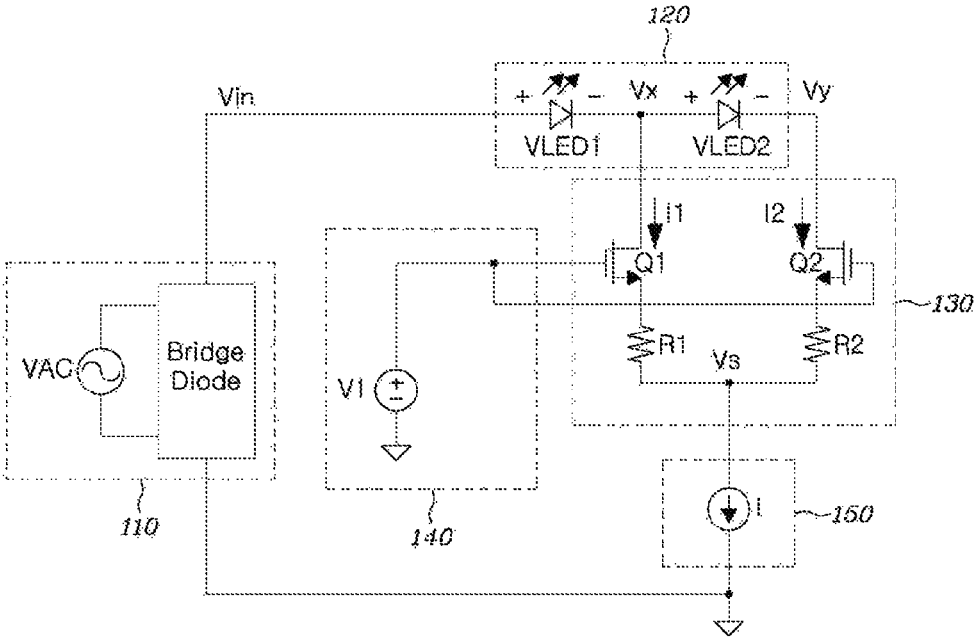
FIG. 8 illustrates an embodiment of a multi-channel LED driving device of the invention, which is a circuit diagram showing a case where the current commutation unit is configured by adding a resistor to a source (emitter)-coupled pair.

FIG. 8 illustrates a circuit in which a single reference voltage source is used and the resistances of R1 and R2 are set to different values, and in which current commutation causing Q1 to be turned off when Q2 is turned on is implemented.

Figure 9:
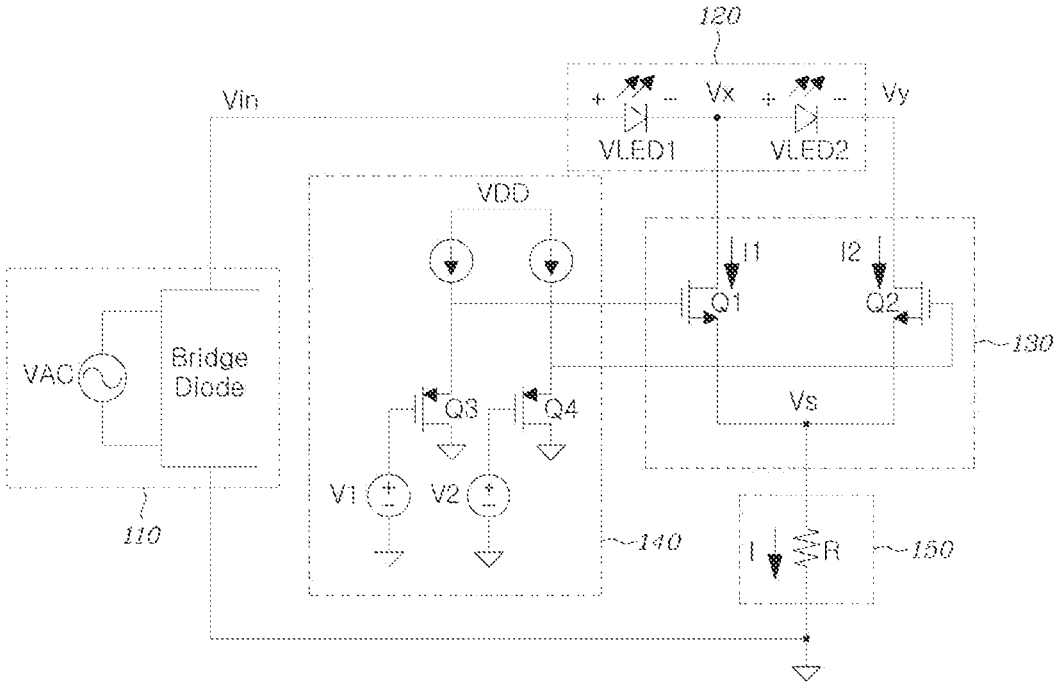
FIG. 9 illustrates an embodiment of a multi-channel LED driving device of the invention, which is a circuit diagram showing a case where a common drain (collector) circuit is added to a reference voltage unit.

FIG. 9 illustrates a circuit in which a P-metal-oxide-semiconductor field-effect transistor (P-MOSFET) (PNP) common drain (collector) circuit is added to the reference voltage unit 140 in FIG. 6. In this case, I1 and I2 are determined by the following equations:

$$I1=(V1+\mathrm{VGS3}-\mathrm{VGS1})/R\approx V1/R$$

$$I2=(V2+\mathrm{VGS4}-\mathrm{VGS2})/R\approx V2/R$$

As given in the above equations, if the VGS voltage of a P-MOSFET is set to a voltage identical to the VGS voltage of an N-MOSFET, variations in I1 and I2 depending on variations in the temperature of VGS may be minimized.

Figure 10:
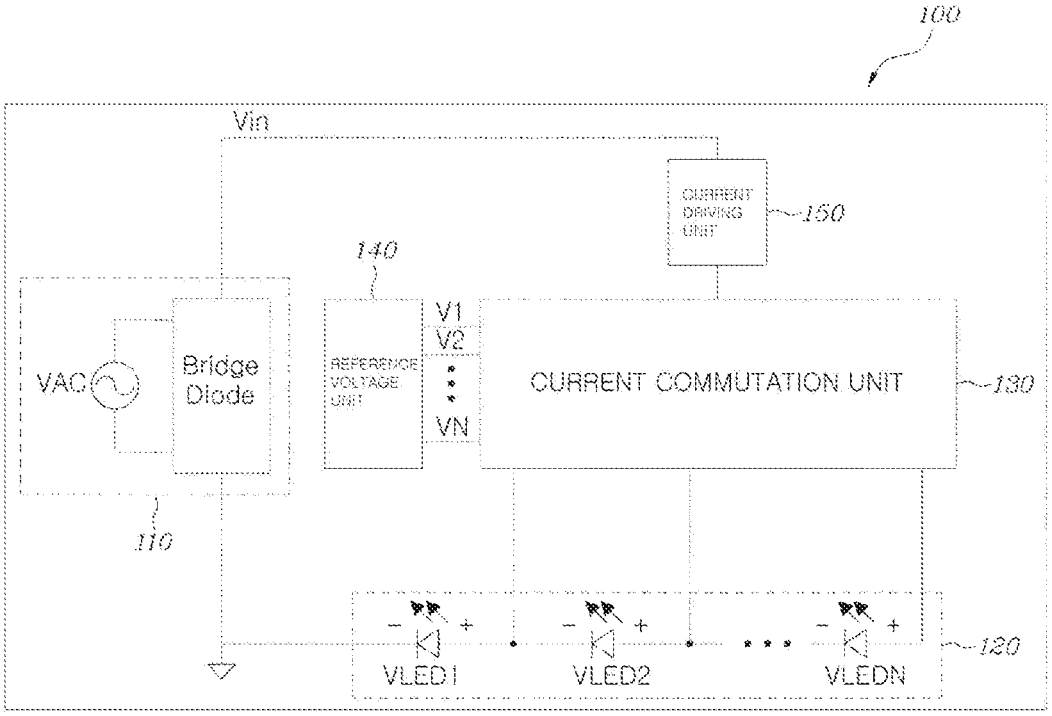
FIGS. 10 and 11 illustrate embodiments of a multi-channel LED driving device of the present invention, which are circuit diagrams showing the configuration of complementary circuits.

FIG. 10 is a block diagram showing a multi-channel LED driving device 100 that is operated to be complementary to the multi-channel LED driving device 100 shown in FIG. 1. All of a current driving unit 150, a reference voltage unit 140, and a current commutation unit 130 are connected to the upper side of an input voltage source, and an LED block 120 is connected to the lower side of the input voltage source, rather than the upper side thereof, and causes current that is flowing down to flow through the LED block 120. Compared to FIG. 1, this structure has a shape in which all blocks of FIG. 1 are vertically inverted, and is identical to a form that can be frequently seen when an N-type MOSFET (NPN transistor) circuit is converted into a P-type MOSFET (PNP transistor) circuit.

Figure 11:
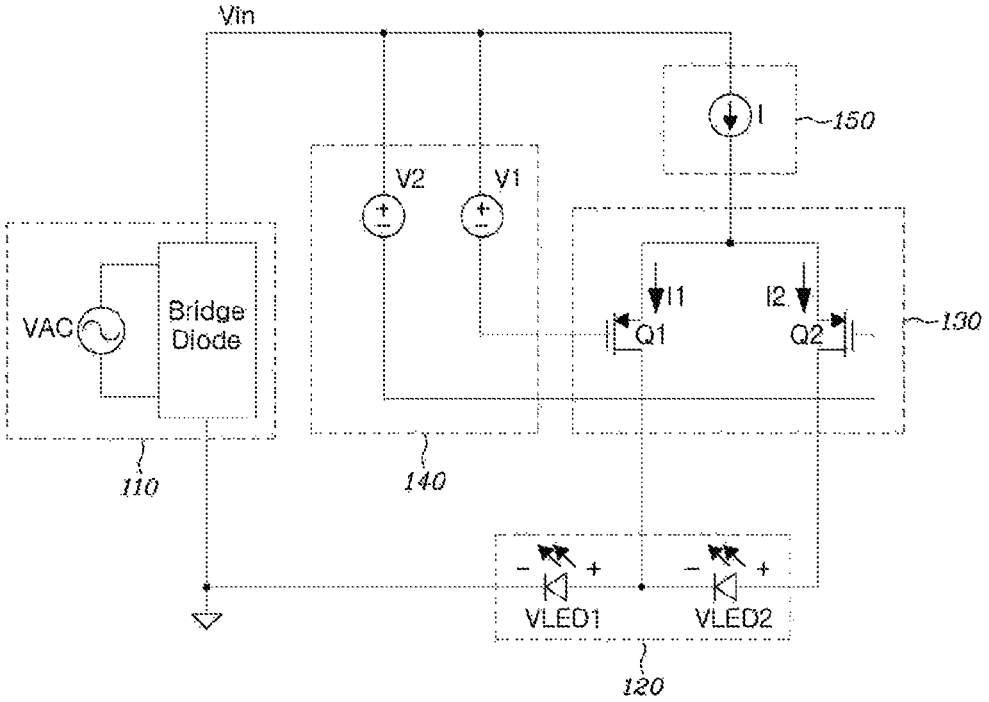

FIG. 11 is a circuit diagram showing an example of the configuration of a complementary circuit. In detail, a circuit implemented using P-MOSFETs (PNP transistors) is illustrated. FIG. 11 illustrates a complementary circuit which has the vertically inverted shape of the basic circuit shown in FIG. 2, but the operating principle thereof is identical to that of the basic circuit shown in FIG. 2. As a result, the circuits shown in FIGS. 2 to 9 can be complementarily modified and applied in the same manner.

Figure 12:
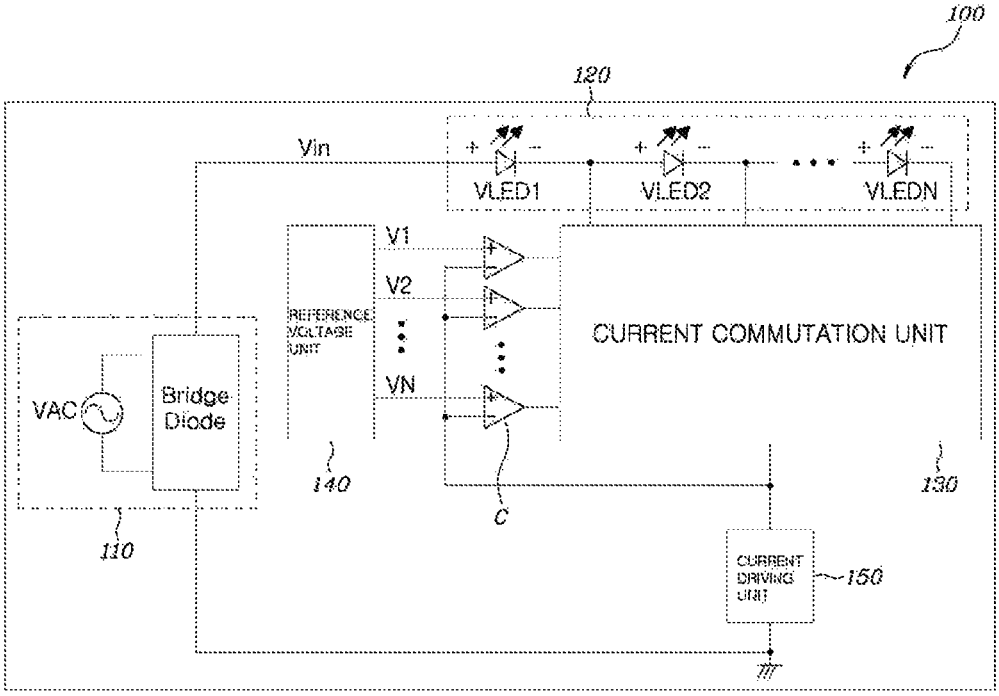
FIG. 12 is a circuit diagram showing a case where amplifiers are added to the current commutation unit of the multi-channel LED driving device of FIG. 1.

FIG. 12 is a block diagram showing a configuration in which amplifiers (AMPs) C are added to the current commutation unit 130 in the multi-channel LED driving device 100 shown in FIG. 1. Compared to the circuit shown in FIG. 1, the voltage supply unit, the LED block 120, the current commutation unit 130, the reference voltage unit 140, and the current driving unit 150 are identical to those of the circuit of FIG. 1, with the exception of the amplifiers C connected to the current commutation unit 130.

Each of the AMPs C functions to allow the current commutating operation of the current commutation unit 130 to be smoothly performed even when a difference between the reference voltages of the reference voltage unit 140 is small. In this case, the AMPs C may be comparators. Therefore, since the AMPs C function to increase the functions of the current commutation unit 130, the AMPs C may be included in the current commutation unit 130 as an embodiment of the invention. That is, the current commutation unit 130 may be considered to include the AMPs C, and a structure in which AMPs C are included in the current commutation unit 130 will be described in the following circuits.

Figure 13:
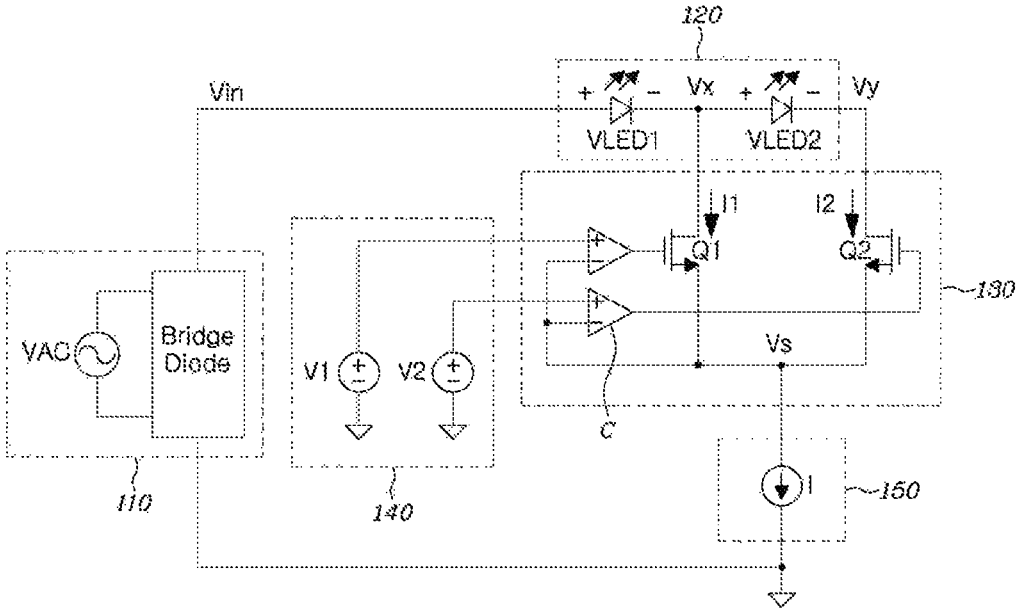
FIG. 13 is a circuit diagram showing a case where two channels are present in the circuit diagram of FIG. 12.

FIG. 13 is a diagram showing the operating principle of the block diagram shown in FIG. 12. That is, this is a view showing a case where two channels are present in the multi-channel LED driving device 100 to which AMPs C are added to the current commutation unit 130.

The AMPs C compare voltages V1 and V2 of the reference voltage unit 140 with Vs of the current driving unit 150 and amplify the results of the comparison. A feedback path is formed in this way, so that a difference between the gate (base) voltages of Q1 and Q2 is amplified, and thus current commutation may be definitely performed even when a difference between input voltages is small. In an interval during which the input voltage satisfies VLED1<Vin<VLED2, current I1 flowing through a first LED group is identical to current I flowing through the current driving unit 150. In this case, voltage Vs becomes identical to V1 via the feedback operation of the AMPs C. Further, although the output of the AMP C having V2 as an input rises up to a maximum output voltage, VLED2 enters a turned-off state, and then 12=0 A.

In an interval during which the input voltage satisfies Vin>VLED1+VLED2, the gate (base) voltage of Q2 is set to a high voltage, and thus I2 starts to flow and the voltage Vs rises. A rise in the voltage Vs decreases the gate (base) voltage of Q1, so that, if Vs=V2, then I2=I and I1=0 A are consequently obtained. A transition from I1 to I2 occurs in a condition in which current that can be supplied by VLED2 flows, and occurs near a position where the input voltage becomes the sum of voltages VLED1 and VLED2.

Figure 14:
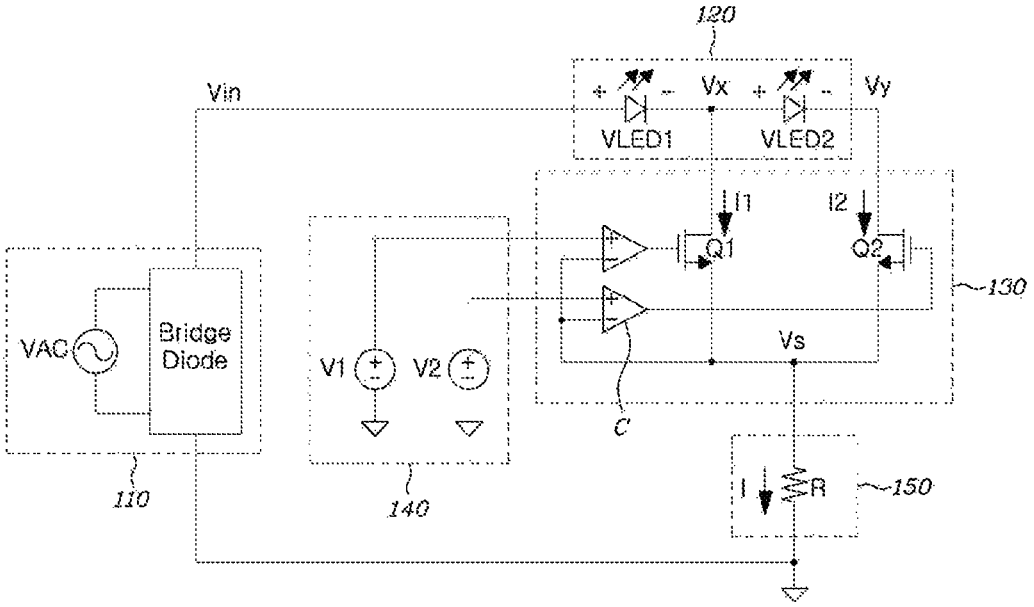
FIG. 14 illustrates an embodiment of a multi-channel LED driving device of the invention, which is a circuit diagram showing a case where a resistor is used in the current driving unit.

FIG. 14 is a block diagram showing a configuration in which the current driving unit 150 shown in FIG. 13 is implemented using a resistor instead of a current source. The current driving unit 150 may always be configured using a current source or a resistor, but current setting conditions are varied. A current commutating operation may be easily performed even at a small difference between voltages V1 and V2 via the operation of AMPs C in the same manner as that of FIG. 13. However, when the current driving unit 150 is implemented using a resistor, currents I1 and I2 are determined depending on the reference voltages V1 and V2 and the resistance of resistor R due to the feedback operation of the AMPs C. In this case, currents flowing through the LED groups depending on input conditions are given as follows.

In an input voltage interval satisfying VLED1<Vin<VLED2, current I1 flowing through the first LED group is given by:

$$I=V1/R, I2=0 \text{ A}$$

In an input voltage interval satisfying Vin>VLED2, current I2 flowing through first and second LED groups is given by:

$$I2=V2/R, I1=0 \text{ A}$$

The current commutating operation is identical to that of FIG. 13, and thus a description thereof will be omitted. That is, when the input voltage increases, current starts to flow through even VLED2, voltage Vs rises, the current I1 decreases, and the current I2 increases, and thus I1=0 A and I2=V2/R are finally obtained.

In contrast, when the input voltage decreases and current flowing through VLED2 decreases, the voltage Vs is reduced, and then current I1 starts to flow through the first LED group. Further, if the input voltage continuously decreases, and current at VLED2 becomes 0 A, I1=V1/R and I2=0 A are obtained.

In this case, in the circuit diagram shown in FIG. 13 and the circuit diagram shown in FIG. 14, current commutation time between I1 and I2 may be reduced compared to that of the circuit diagram shown in FIG. 2. The reason for this is that the amplification operation of the AMPs C makes a difference between the gate (base) voltages of Q1 and Q2 large. The maximum variables required to determine the current commutation time are rising and falling slopes of the input voltage, wherein, as the operating frequency of the input voltage becomes higher, the current commutation time may become shorter.

Figure 15:
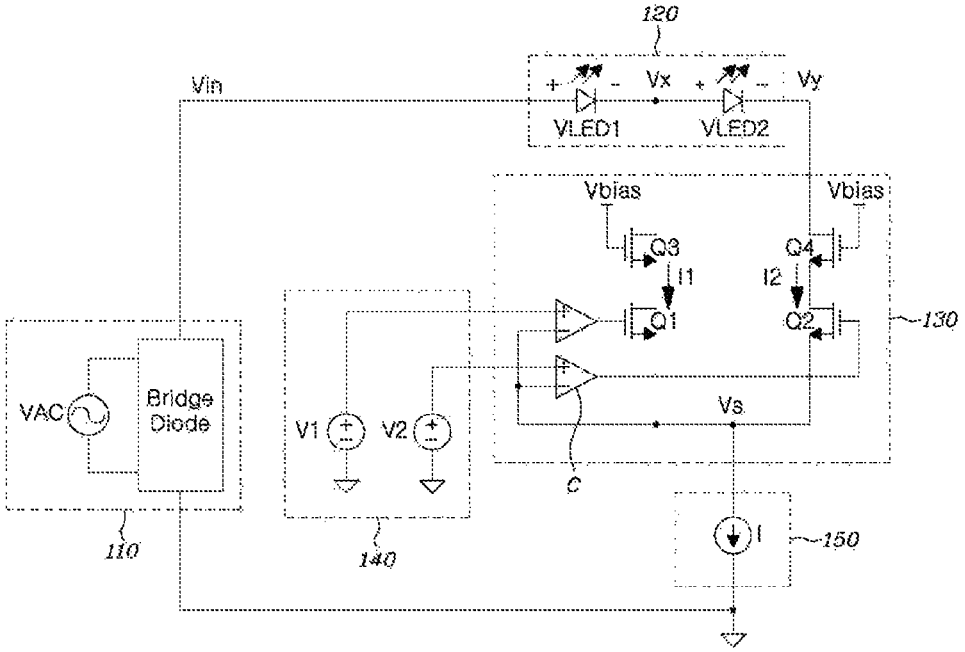
FIG. 15 illustrates an embodiment of a multi-channel LED driving device of the invention, which is a circuit diagram showing a case where a common gate (base) circuit is added to the current commutation unit.

FIG. 15 is a circuit diagram showing a configuration in which a common gate (base) circuit is added, as in the case of FIG. 5, to the current commutation unit 130 of FIGS. 13 and 14. The current driving unit 150 may always be implemented using a current source or a resistor. Further, it is possible to add AMPs C to the current commutation unit, as shown in FIG. 13, in the circuit diagram shown in FIG. 2 and FIGS. 4 to 11, thus enabling a current commutating operation to be performed.

Figure 16:
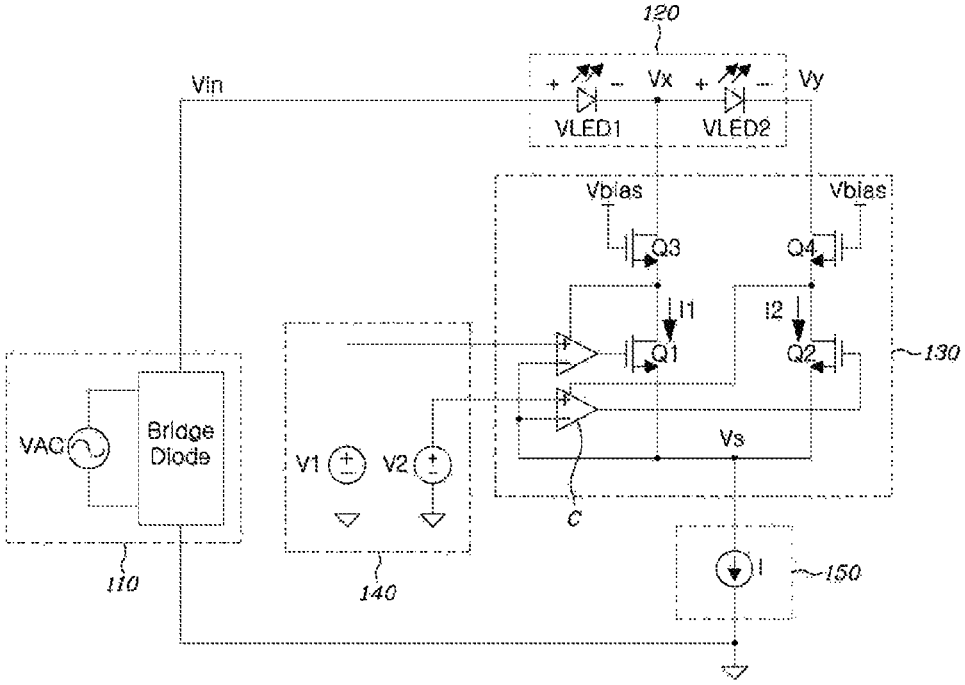
FIG. 16 illustrates an embodiment of a multi-channel LED driving device of the invention, which is a circuit diagram showing a case where amplifiers are connected to the sources (emitters) of a common gate (base) circuit.

FIG. 16 is a circuit diagram showing a configuration in which the operating power of the AMPs C used in FIG. 15 is connected to the sources (emitters) of an upper common gate (base) circuit. In this case, power is not supplied to an AMP C connected to a second LED group until an input voltage sufficient to operate the second LED group is formed. Therefore, current consumed while the second LED group is not operated may be reduced.

Figure 17:
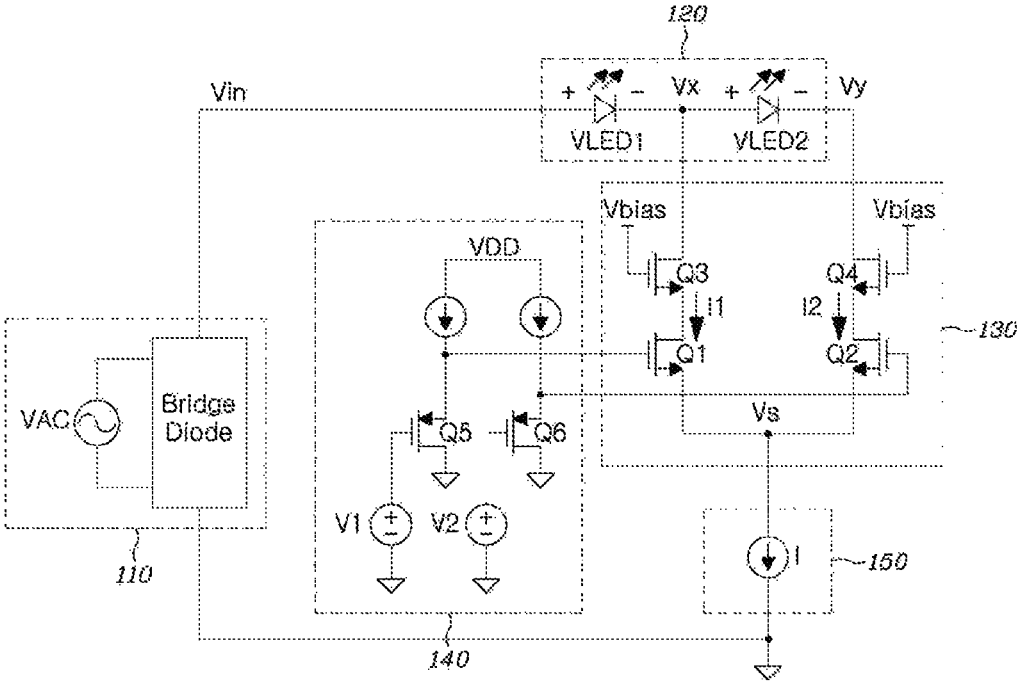
FIG. 17 illustrates an embodiment of a multi-channel LED driving device of the invention, which is a circuit diagram showing a case where a common gate (base) circuit is used in the current commutation unit.

FIG. 17 is a circuit diagram showing a configuration in which a common gate (base) circuit is used in the current commutation unit 130 in the circuit diagram shown in FIG. 9. In this case, a current source used in the reference voltage unit 140 may be replaced by a resistor.

Figure 18:
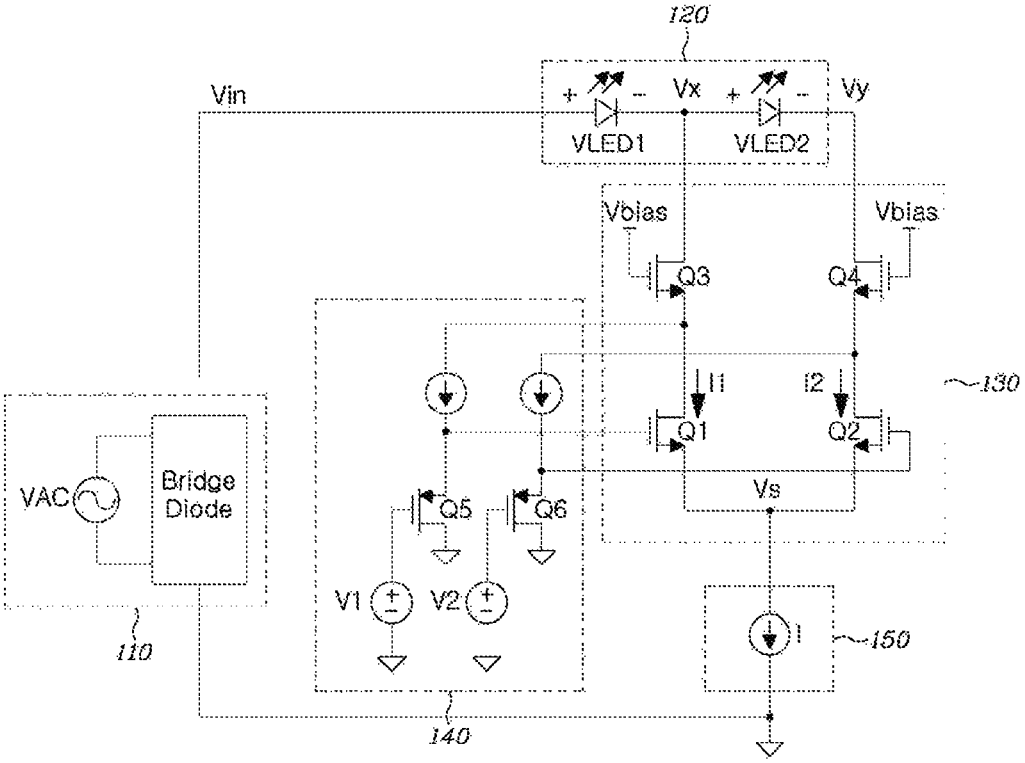
FIG. 18 illustrates an embodiment of a multi-channel LED driving device of the invention, which is a circuit diagram showing a case where the current sources of a reference voltage unit are connected to the sources (emitters) of a common gate (base) circuit.

FIG. 18 is a circuit diagram showing a configuration in which the current sources of the reference voltage unit 140 are connected to the sources (emitters) of an upper common gate (base) circuit rather than a common voltage unit in the circuit diagram of FIG. 17 and are then used. Therefore, as in the circuit diagram shown in FIG. 16, power is not supplied to the reference voltage unit 140 until an input voltage sufficient to operate the second LED group is formed. Therefore, current consumed while the second LED group is not operated may be reduced.

Figure 19:
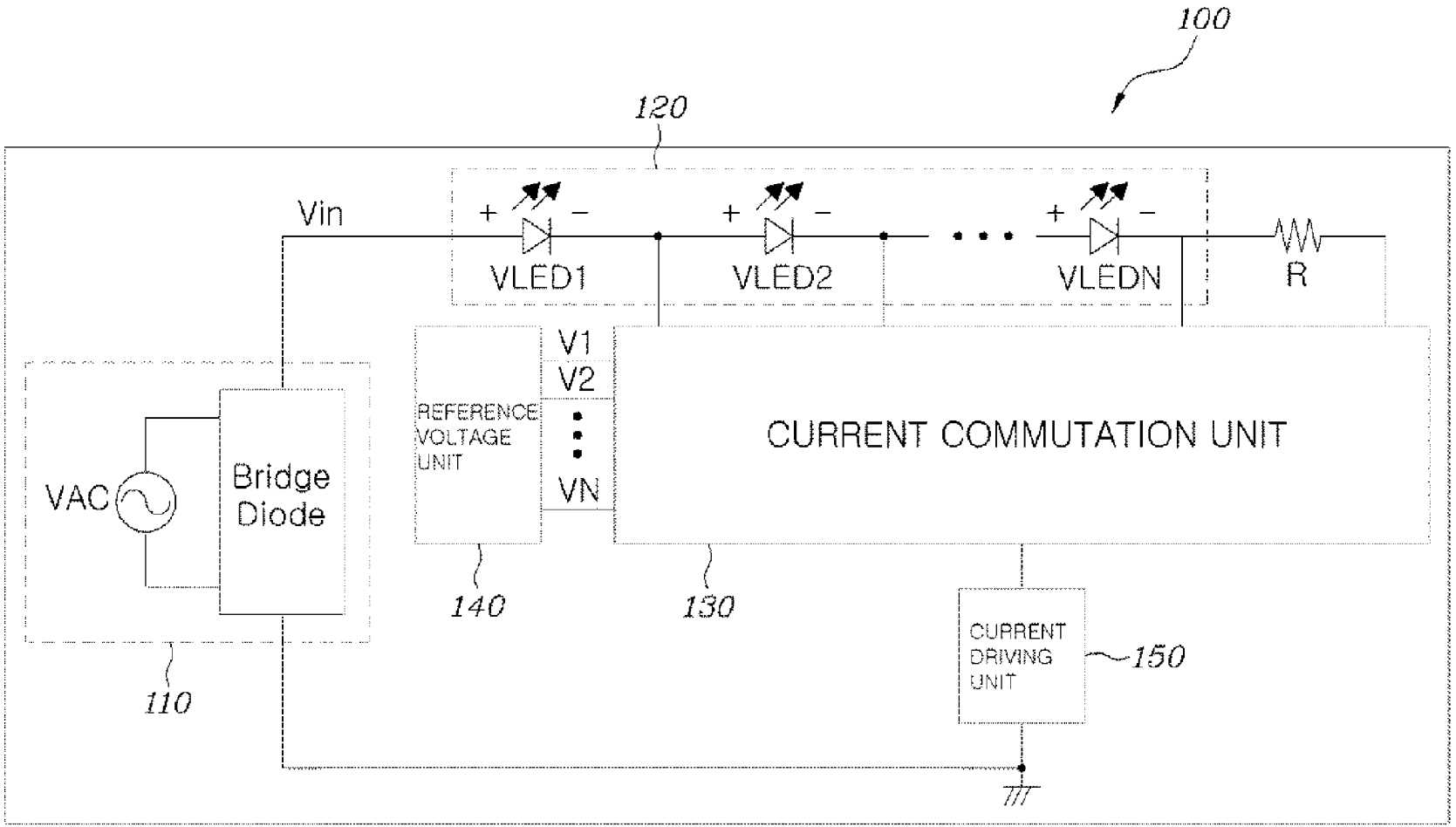
FIG. 19 illustrates an embodiment of a multi-channel LED driving device of the invention, which is a block diagram showing a case where a resistor is included in LED groups.
Figure 20:
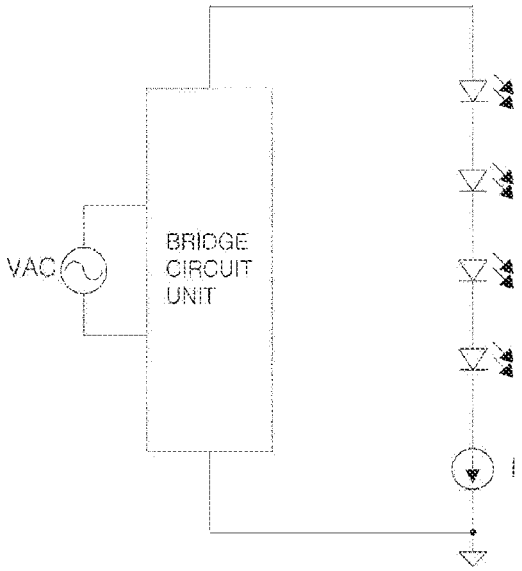
FIGS. 20 and 21 illustrate a conventional LED driving circuit based on a linear driving scheme.
Figure 21:
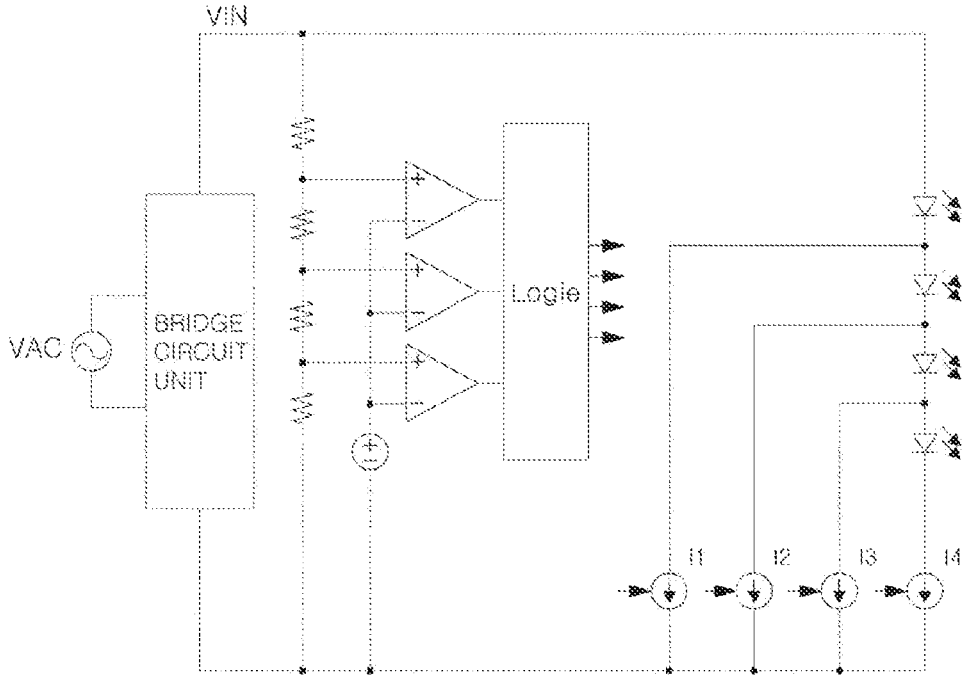
PRIOR ART FIG. 21

FIG. 19 is a block diagram showing a configuration in which a resistor is used in an n+1-th LED group region in the block diagram shown in FIG. 1. In the block diagram of FIG. 1, when an input voltage excessively rises to more than a rated voltage, a voltage to be applied to the transistor of the current commutation unit 130 for driving an n-th LED group rises. As a result, temperature rises, and thus the reliability of the transistor may be compromised.

In order to address the temperature, a single channel may be added, a resistor may be used instead of an LED group, and a voltage induced at the transistor may be shifted to the resistor, thus imputing power consumption occurring in the transistor to the resistor. Accordingly, heat occurring in transistors and an Integrated Circuit (IC) or a module including transistors may be reduced.

Since a resistor has the robust characteristics of being inexpensive, desirably releasing heat, and exhibiting constant inherent features even at high heat, the resistor provides increased aid in improving the thermal features of a lighting system under a high-voltage condition. Further, an electrical part such as a zener diode or a typical diode, instead of a resistor, may be used, a combination of a resistor, a zener diode, and a typical diode may be used, or a combination of an LED, a resistor, a zener diode, and a typical diode may be used.

The transistors used in the above description and drawings have been represented based on MOSFETs, and typical transistors have been represented in parentheses. Further, transistors that may be used in the present invention may include at least one of an insulated-gate bipolar transistor (IGBT), a bipolar junction transistor (BJT), and a junction gate field-effect transistor (JFET), as well as the use of a Darlington structure and a cascode structure in which BJTs or MOSFETs are used.

As described above, the invention has been made based on the embodiments described with reference to the attached drawings. As such, the above embodiments are merely described as examples of the invention, and thus it should be understood that the invention is not limited to the above embodiments, and the scope of the invention should be defined by the accompanying claims and equivalents thereof.

The invention claimed is:

1. A multi-channel Light Emitting Diode (LED) driving device, comprising:

a power supply unit to supply externally supplied power;

a light emitting diode block connected to a positive (+) terminal of the power supply unit, the light emitting diode block including a plurality of light emitting diode groups, each having at least one light emitting diode;

a current commutation unit connected to a cathode of the light emitting diode block, the current commutation unit to commutate current flowing through the light emitting diode groups;

a reference voltage unit electrically connected to the current commutation unit, the reference voltage unit to provide a reference voltage to the current commutation unit; and a current driving unit supplied with the power from the power supply unit to drive the light emitting diode block via the current commutation unit and determine drive current flowing through the light emitting diode groups, wherein the current commutation unit includes one or more transistors, respectively, electrically connected to the light emitting diode groups included in the light emitting diode block, and wherein each of the a plurality of transistors included in the current commutation unit comprises a collector connected to a cathode of a corresponding light emitting diode group, a base electrically connected to the reference voltage unit, and an emitter directly coupled to other emitters of the plurality of transistors and to the current driving unit.

2. The multi-channel light emitting diode driving device of claim 1, wherein the plurality of transistors are N-type metal-oxide-semiconductor field-effect transistors (MOSFETs) or NPN transistors.

3. The multi-channel light emitting diode driving device of claim 1, wherein the drive current determined by the current driving unit is determined to be proportional to an input voltage.

4. The multi-channel light emitting diode driving device of claim 1, wherein:

the current driving unit determines the drive current so that currents having different magnitudes flow through the light emitting diode groups, depending on driving of the light emitting diode groups.

5. The multi-channel light emitting diode driving device of claim 1, wherein:

the current driving unit includes a resistor, the reference voltage unit includes a plurality of reference voltage sources, respectively, electrically connected to the plurality of light emitting diode groups, and the current driving unit determines the drive current so that different currents flow through the plurality of light emitting diode groups, depending on reference voltages respectively supplied by the plurality of reference voltage sources and the resistor.

6. The multi-channel light emitting diode driving device of claim 1, wherein:

the current commutation unit includes a plurality of transistors, and the reference voltage unit includes a common collector circuit to improve temperature characteristics of drive current determined when a resistor is included in the current driving unit.

7. The multi-channel light emitting diode driving device of claim 6, wherein a bias circuit of the common collector circuit is either implemented using an internal reference voltage or connected to an emitter of a common base circuit.

8. The multi-channel light emitting diode driving device of claim 6, wherein a bias circuit of the common collector circuit is implemented using a current source or a resistor.

9. The multi-channel light emitting diode driving device of claim 1, wherein:

the current commutation unit includes a plurality of transistors, and the current commutation unit further includes a common base circuit.

10. The multi-channel light emitting diode driving device of claim 1, wherein:

the current commutation unit includes a plurality of transistors, and sizes of the plurality of transistors are different to each other.

11. The multi-channel light emitting diode driving device of claim 10, wherein the reference voltage unit provides a single reference voltage to the current commutation unit.

12. The multi-channel light emitting diode driving device of claim 1, wherein:

the current commutation unit includes a plurality of transistors, the current commutation unit further includes a plurality of resistors respectively connected to emitters of the plurality of transistors, and resistance values of the resistors respectively connected to the plurality of transistors are different to each other.

13. The multi-channel light emitting diode driving device of claim 1, wherein:

the current commutation unit includes amplifiers for amplifying voltages input from the reference voltage unit, and respective bases of the plurality of transistors are electrically connected to the amplifiers.

14. The multi-channel light emitting diode driving device of claim 13, wherein an input voltage of the amplifiers is either implemented using an internal reference voltage or connected to an emitter of a common base circuit.

15. The multi-channel light emitting diode driving device of claim 1, wherein the current commutation unit is to implement a Darlington circuit using bipolar junction transistors (BJTs) or MOSFETs.

16. The multi-channel light emitting diode driving device of claim 1, wherein:

the reference voltage unit includes a plurality of reference voltage sources, respectively, electrically connected to the plurality of light emitting diode groups, and the plurality of reference voltage sources set different voltages, wherein a difference between the voltages of the reference voltage sources is a voltage difference enabling the current commutation unit to commutate current flowing through the light emitting diode groups using the drive current determined by the current driving unit.

17. The multi-channel light emitting diode driving device of claim 1, wherein:

the plurality of light emitting diode groups are connected in series.

18. The multi-channel light emitting diode driving device of claim 1, wherein the current commutation unit includes an amplifier for amplifying a voltage input from the reference voltage unit.

19. The multi-channel light emitting diode driving device of claim 1, wherein the current commutation unit includes comparators for comparing two or more reference voltages input from the reference voltage unit.

20. The multi-channel light emitting diode driving device of claim 1, wherein the light emitting diode block includes one or more of a resistor, a zener diode, and a typical diode electrically connected to the plurality of light emitting diode groups.

21. A multi-channel Light Emitting Diode (LED) driving device, comprising:

a power supply unit to supply externally supplied power;

a light emitting diode block connected to a negative (−) terminal of the power supply unit, the light emitting diode block including a plurality of light emitting diode groups, each having at least one light emitting diode;

a current commutation unit connected to an anode of the light emitting diode block, the current communication unit to commutate current flowing through the light emitting diode groups;

a reference voltage unit electrically connected to the current commutation unit, the reference voltage unit to provide a reference voltage to the current commutation unit; and a current driving unit supplied with the power from the power supply unit, the current driving unit to drive the light emitting diode block via the current commutation unit and determine drive current flowing through the light emitting diode groups wherein the current commutation unit includes plurality of transistors, respectively, electrically connected to the light emitting diode groups included in the light emitting diode block, and wherein each of the plurality of transistors included in the current commutation unit comprises a collector connected to an anode of a corresponding light emitting diode group, a base electrically connected to the reference voltage unit, and an emitter directly coupled to other emitters of the plurality of transistors and to the current driving unit.

22. The multi-channel light emitting diode driving device of claim 21, wherein the drive current determined by the current driving unit is determined to be proportional to an input voltage.

23. The multi-channel light emitting diode driving device of claim 21, wherein:

the current driving unit determines the drive current so that currents having different magnitudes flow through the light emitting diode groups depending on driving of the light emitting diode groups.

24. The multi-channel light emitting diode driving device of claim 21, wherein:

the current driving unit includes a resistor, the reference voltage unit includes a plurality of reference voltage sources, respectively, electrically connected to the plurality of light emitting diode groups, and the current driving unit determines the drive current so that different currents flow through the plurality of light emitting diode groups depending on reference voltages respectively supplied by the plurality of reference voltage sources and the resistor.

25. The multi-channel light emitting diode driving device of claim 21, wherein:

the current commutation unit includes a plurality of transistors, and the reference voltage unit includes a common collector circuit to improve temperature characteristics of drive current determined when a resistor is included in the current driving unit.

26. The multi-channel light emitting diode driving device of claim 25, wherein a bias circuit of the common collector circuit is either implemented using an internal reference voltage or connected to an emitter of a common base circuit.

27. The multi-channel light emitting diode driving device of claim 25, wherein a bias circuit of the common collector circuit is implemented using a current source or a resistor.

28. The multi-channel light emitting diode driving device of claim 21, wherein:

the current commutation unit includes a plurality of transistors, and the current commutation unit further includes a common base circuit.

29. The multi-channel light emitting diode driving device of claim 21, wherein:

the current commutation unit includes a plurality of transistors, and the sizes of the plurality of transistors are different to each other.

30. The multi-channel light emitting diode driving device of claim 29, wherein the reference voltage unit provides a single reference voltage to the current commutation unit.

31. The multi-channel light emitting diode driving device of claim 21, wherein:

the current commutation unit includes a plurality of transistors, the current commutation unit further includes a plurality of resistors respectively connected to emitters of the plurality of transistors, and resistance values of the resistors respectively connected to the plurality of transistors are different to each other.

32. The multi-channel light emitting diode driving device of claim 21, wherein:

the current commutation unit includes amplifiers for amplifying voltages input from the reference voltage unit, and respective bases of the plurality of transistors are electrically connected to the amplifiers.

33. The multi-channel light emitting diode driving device of claim 32, wherein an input voltage of the amplifiers is either implemented using an internal reference voltage or connected to an emitter of a common base circuit.

34. The multi-channel light emitting diode driving device of claim 21, wherein:

the reference voltage unit and the current driving unit set a voltage at a positive (+) terminal of the voltage supply unit to a reference voltage, and the current commutation unit is implemented using a P-type MOSFET or a PNP transistor.

35. The multi-channel light emitting diode driving device of claim 21, wherein:

the reference voltage unit includes a plurality of reference voltage sources, respectively, electrically connected to the plurality of light emitting diode groups, and the plurality of reference voltage sources set different voltages, wherein a difference between the voltages of the reference voltage sources is a voltage difference enabling the current commutation unit to commutate current flowing through the light emitting diode groups using the drive current determined by the current driving unit.

36. The multi-channel light emitting diode driving device of claim 21, wherein:

the plurality of light emitting diode groups are connected in series.

37. The multi-channel light emitting diode driving device of claim 21, wherein the current commutation unit includes an amplifier for amplifying a voltage input from the reference voltage unit.

38. The multi-channel light emitting diode driving device of claim 21, wherein the current commutation unit includes comparators for comparing two or more reference voltages input from the reference voltage unit.

39. The multi-channel light emitting diode driving device of claim 21, wherein the light emitting diode block includes one or more of a resistor, a zener diode, and a typical diode electrically connected to the light emitting diode groups.

* * * * *